US008567356B2

(12) United States Patent
Jacobsson

(10) Patent No.: US 8,567,356 B2
(45) **Date of Patent: *Oct. 29, 2013**

(54) DRILL RIG AND METHOD FOR CONTROLLING A FAN THEREIN

(75) Inventor: Henrik Jacobsson, Vretstorp (SE)

(73) Assignee: Atlas Copco Rock Drills AB, Orebro (SE)

( * ) Notice: Subject to any disclaimer, the term of this patent is extended or adjusted under 35 U.S.C. 154(b) by 1283 days.

This patent is subject to a terminal disclaimer.

(21) Appl. No.: 12/090,381

(22) PCT Filed: Oct. 18, 2005

(86) PCT No.: PCT/SE2005/001549

§ 371 (c)(1),
(2), (4) Date: Sep. 22, 2008

(87) PCT Pub. No.: WO2006/046902

PCT Pub. Date: May 4, 2006

(65) Prior Publication Data

US 2009/0242273 A1 Oct. 1, 2009

(30) Foreign Application Priority Data

Oct. 27, 2004 (SE) ..... 0402593

(51) Int. Cl.
*F01P 7/14* (2006.01)
*F01P 7/16* (2006.01)

(52) U.S. Cl.
USPC ..... 123/41.08; 123/41.12; 123/41.15; 123/41.31; 123/41.49

(58) Field of Classification Search
USPC ..... 173/17, 204, 186, 27, 44, 4, 151, 20; 91/273, 170 R, 243; 123/41.24, 41.04, 123/41.05, 41.1, 41.31, 41.33, 41.51, 41.12, 123/41.15; 165/41; 180/68.1, 68.4
See application file for complete search history.

(56) References Cited

U.S. PATENT DOCUMENTS 4,231,434 A * 11/1980 Justus ..... 173/204
4,474,248 A * 10/1984 Musso ..... 173/17

(Continued)

FOREIGN PATENT DOCUMENTS

DE 195 20 122 A1 5/1996
DE 19710384 A1 9/1998

(Continued)

OTHER PUBLICATIONS

Japanese Office Action, dated May 13, 2011, in Application No. 2007-538853.

(Continued)

*Primary Examiner* — Noah Kamen
(74) *Attorney, Agent, or Firm* — Young & Thompson

(57) ABSTRACT

A method for controlling at least one fan (13) for the regulation of the cooling demand of at least two cooling elements (12) included in a drill rig (1), the cooling demand of each one of the cooling elements (12) being determined, that the determined cooling demands are weighted together and that the fan (13) is controlled based on the weighting together. The method is characterized in that at least one of the cooling elements is equipped with a safety thermostat (21), which, if required, prevents overcooling that the fluid is not allowed to circulate in the cooling elements. The invention also relates to a drill rig for the execution of the above-mentioned method.

19 Claims, 3 Drawing Sheets

(56) References Cited

U.S. PATENT DOCUMENTS

| | | | | |
|---|---|---|---|---|
| 4,479,532 | A | 10/1984 | Watanabe | |
| 4,998,510 | A | 3/1991 | Rognon | |
| 5,692,467 | A | 12/1997 | Sahm et al. | |
| 6,079,536 | A * | 6/2000 | Hummel et al. | 192/58.62 |
| 6,349,882 | B1 | 2/2002 | Kita et al. | |
| 6,463,891 | B2 * | 10/2002 | Algrain et al. | 123/41.12 |
| 6,615,647 | B2 | 9/2003 | Niki | |
| 2001/0029907 | A1 | 10/2001 | Algrain et al. | |
| 2004/0069546 | A1 | 4/2004 | Lou et al. | |

FOREIGN PATENT DOCUMENTS

| | | | |
|---|---|---|---|
| EP | 0 369 148 | A2 | 5/1990 |
| JP | 2000-083351 | | 3/2000 |
| JP | 2001-280134 | | 10/2001 |
| JP | 3295650 | B2 | 6/2002 |

OTHER PUBLICATIONS

European Search Report, Dated Oct. 27, 2010, in EP 05793290.

* cited by examiner

DRILL RIG AND METHOD FOR CONTROLLING A FAN THEREIN

TECHNICAL FIELD OF THE INVENTION

This invention relates to a method for controlling at least one fan for the regulation of the cooling demand of at least two cooling elements comprised in a drill rig, the cooling demand of each one of the cooling elements being determined, that the determined cooling demands are weighted together and that the fan is controlled based on said weighting together.

The invention also relates to a drill rig comprising an engine, at least two cooling elements and at least one fan, a control unit being arranged to control the fan based on a weighting together, executed in the control unit, of current cooling demands in the cooling elements.

By drill rigs, in particular drill rigs for drilling in rock are intended and above all drill rigs for drilling in rock above ground.

BACKGROUND OF THE INVENTION AND PRIOR ART

The background of the present invention is the need of being able to provide cooling in a drill rig, or in a drilling unit, which is an established synonymous concept in the technical field, to all the cooling-dependent components that are arranged therein. By cooling-dependent components, for instance, engine, compressors and hydraulic-oil pumps are intended, as well as the fluids that circulate in the above-mentioned system and that run the risk of accumulating too much heat upon use. Said components with the appurtenant cooling elements and fans associated therewith are accommodated in an engine house arranged in the drill rig. The cooling elements consist, for instance, of an engine water cooler, a charge-air cooler, a hydraulic-oil cooler and a compressor cooler.

A generally recognized way to solve the above-mentioned problems is to place one or more fans, which presses or sucks air through cooling elements intended for the purpose. Previously, the fans have rotated at the highest rotation speed, highest power, all the time the drill rig has been in operation, without regulation of the same and independently of the cooling demand of the components of the drill rig.

Frequently or always, the different cooling elements have different instantaneous needs of cooling air, which makes the fan, consequently more or less all the time, operating more than necessary in relation to the need for either of the cooling elements or even all cooling elements.

The problem with the above-mentioned way of controlling, or to be precise, not controlling the fans, is that the cooling elements that have lower cooling demand than what the fans provide run the risk of becoming overcooled, above all when the drill rig is used in cold climates.

An additional disadvantage of letting the fan operate at a constantly high rotation speed (highest power) is that the sound level from the fans and thereby also the sound level in the driver's cab is pronounced.

OBJECTS AND FEATURES OF THE INVENTION

The present invention aims at obviating the above-mentioned disadvantages of previously known fan controls and presenting an improved solution. A primary object is to present a fan control, which provides a more efficient and more adapted cooling for the cooling elements of the drill rig.

A second object is to present a fan control, which allows drill rigs to be used in colder climates without the components included in the drill rig running the risk of becoming overcooled. An additional object is to provide a drilling unit having closer-to-optimal temperature of the fluids that are in need of cooling. Still another object is to present a fan system being more silent in operation.

In a first aspect, this invention relates to a method of the type defined by way of introduction, which is characterized in that at least one cooling element is equipped with a safety thermostat, which, if required, prevents overcooling by the fact that the fluid in question is not allowed to circulate in this cooling element.

In a second aspect, the invention also relates to a drilling unit according to claim 7 for execution of the method. Preferred embodiments of the inventive drill rig are further seen in the dependent claims 8 to 16. The advantage of said method and device is that the speed of rotation/effect of the fan is adjustable, which entails that the air flow that passes through the cooling elements at each instant of time in a better way corresponds to the cooling demand that the same have at said instant of time. Thanks to the closer-to-optimal fluid temperatures with reduced temperature variations, the stress on the components of the systems decreases, which increases the service life of the same. By regulating the rotation speed of the fan, so that it does not operate with constantly high rotation speed (highest power), also the sound level in and around the drill rig is lowered. A lower rotation speed of the fan further entails a smaller power output from the engine and accordingly reduced fuel consumption.

Additional advantages and features of the invention are seen in the following, detailed description of preferred embodiments.

BRIEF DESCRIPTION OF THE APPENDED DRAWINGS

Hereinafter, the invention will be described with an exemplifying purpose, reference being made to the accompanying drawings, in which.

DETAILED DESCRIPTION OF PREFERRED EMBODIMENTS

Figure 1:
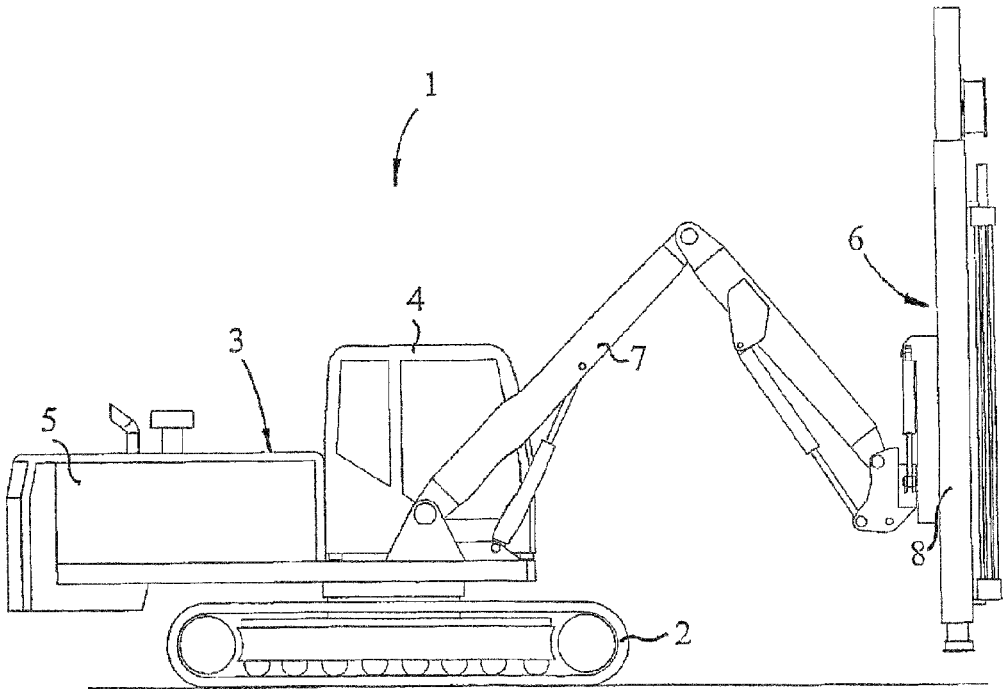
FIG. 1 is a side view of a drill rig according to the invention.

In FIG. 1, a drill rig according to the invention is shown, generally designated 1. The drill rig 1 comprises a carrier 3 carried by a pair of caterpillars 2, or the like, and comprising a driver's cab 4 and an engine house-forming chassis 5. The engine house 5 is in no way tight but comprises holes and openings so that good circulation-of-air therein is allowed. In the front part of the carrier 3, a feeder 6 is arranged, which is carried by one or more bars 7 and which comprises a drilling equipment 8, which is carried by the bars 7. The radius of working and accessibility of the drill rig 1 is determined by the bars 7 and the drilling equipment 8, which are of conventional type.

Figure 2:
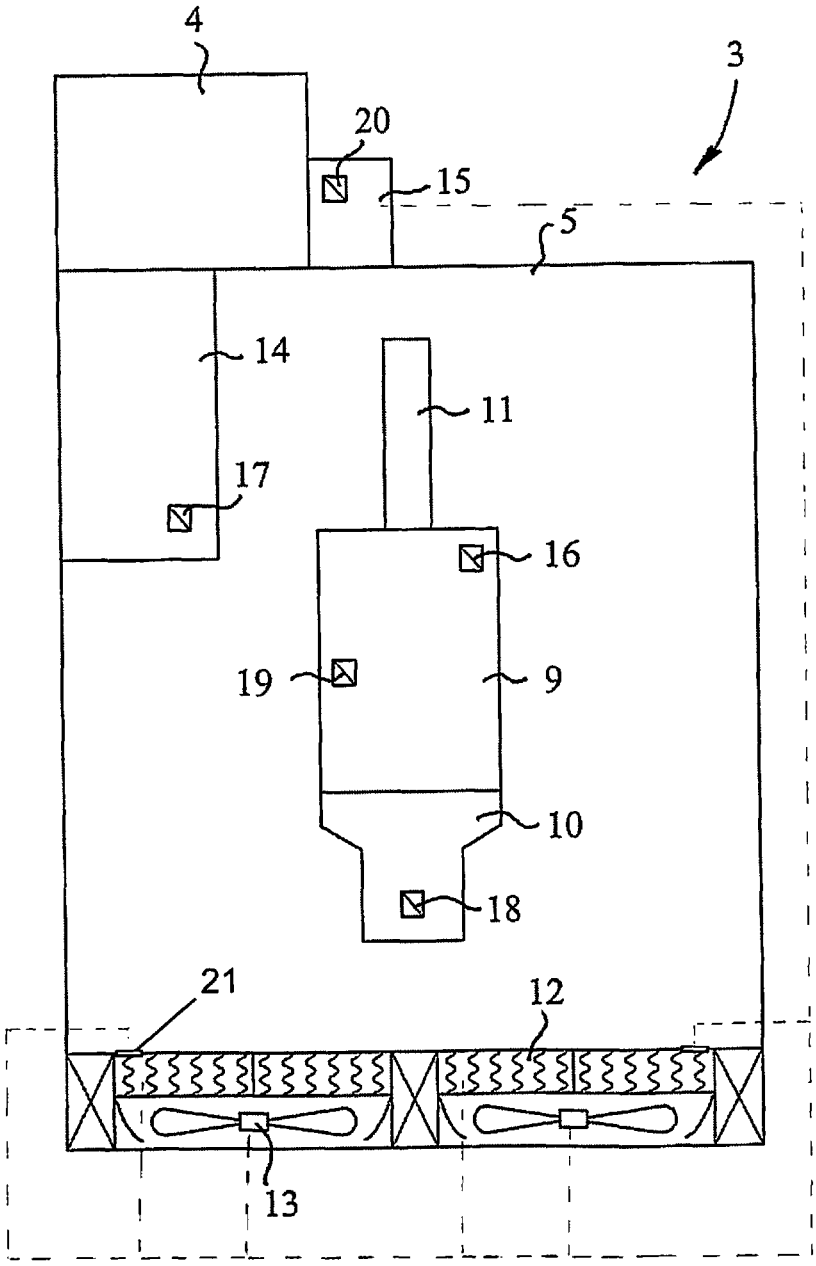
FIG. 2 is a schematic, partially cut view from above of a carrier included in the drill rig.

Now reference is made primarily to FIG. 2, in which a partially cut view from above of the carrier 3 of the drill rig 1 (a plurality of components are eliminated for the sake of clarity) is schematically shown. Centrally in the engine house 5, an engine 9 is arranged, preferably an internal combustion engine and in particular a diesel engine, which is connected to a compressor 10 and one or more hydraulic-oil pumps 11 for the supply of power to, for instance, the drilling equipment 8 of the drill rig 1. As these components or fluids associated therewith have substantial cooling demands, cooling elements 12 or coolers are further arranged in the rear part of the engine house 5, which coolers, for instance, consist of engine water coolers, charge-air coolers, hydraulic-oil coolers and compressor-oil cooler. The cooling elements 12 are connected to the respective unit in such a way that the fluids used in the units can circulate between the cooling elements 12 and the units. At the cooling elements 12, one or more fans 13 are arranged, which, in a preferred embodiment, are hydraulically driven, but alternatively they may, for instance, be driven pneumatically or electrically, i.e., the fans 13 may be arranged to be driven by a suitable power system present on the drill rig 1. Furthermore, a hydraulic-oil tank 14 is arranged in the engine house 5 and in a suitable way connected to the hydraulic-oil pump 11 and remaining parts of the hydraulic-oil system.

In the embodiment shown, the fans 13 are located downstreams of the cooling elements 12, since it from a flow point of view, at a short distance, is easier to suck than press air between closely located cooling flanges. However, from a space point of view, it may be preferred to place the fans 13 upstreams of the cooling elements 12. In the same way, the design of the engine house 5 entails that the cooling elements 12 in the embodiment shown are divided into groups, more precisely two by two, with an individual fan 13 for each group. The cooling elements 12 may advantageously be divided into groups including cooling elements 12 having similar cooling demand in the respective group. In the embodiment example according to FIG. 2, hence, it is advantageous to place the cooling elements 12 for the hydraulic oil and the compressor oil together and for the engine water and the charge air together.

Figure 3:
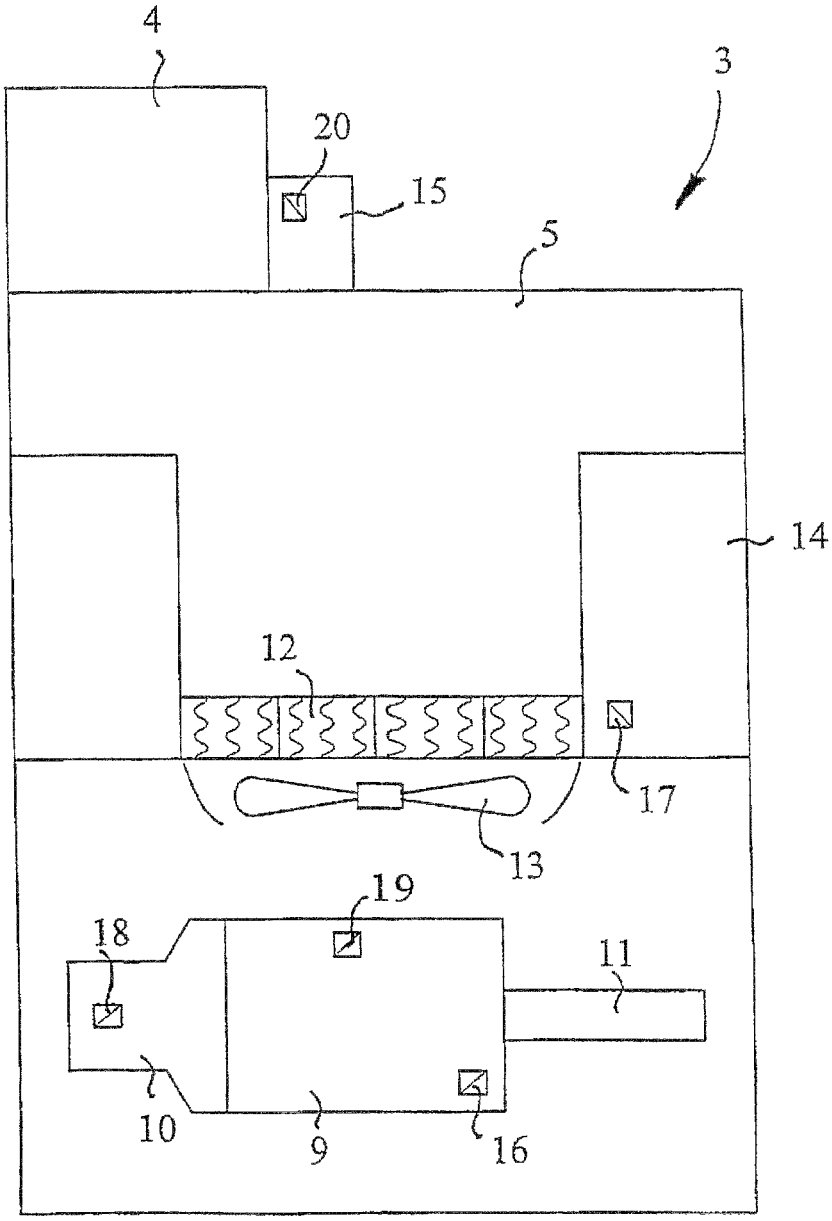
FIG. 3 is an alternative embodiment of the carrier corresponding to FIG. 2.

Now reference is made also to FIG. 3, in which an alternative embodiment of the carrier 3 of the drill rig 1 is shown. In this alternative embodiment, in contrast to FIG. 2, the engine 9, the compressor 10 and the hydraulic-oil pumps 11 are transverse to the longitudinal direction of the drill rig 1 and placed in the rear part of the engine house 5. Furthermore, the cooling elements 12 are placed centrally in a group and with a common fan 13, located downstreams of the cooling elements 12. In addition, the location of the hydraulic-oil tank 14 has also been changed.

Common to the two alternative configurations in FIGS. 2 and 3 is that they comprise a control unit 15, which in the figures is outlined to be located near the driver's cab 4. The control unit 15 should be programmable and comprise a plurality of inputs and outputs for signal transfer. The control unit 15 may consist of an ordinary control unit in the drill rig 1 or of a specific control unit only for the control of the fan(s) 13. In addition, the control unit 15 may be located on any another suitable location than the one shown in the figures, for instance on the proper engine 9. Furthermore, the drill rig 1 comprises a plurality of sensors to measure operating parameters, such as preferably temperatures, but also other quantities may be measured, such as power output or the like. The temperatures are measured, for instance, of the cooling fluids on suitable places in the respective system. A first sensor 16 is, for instance, located in the engine 9 or in the vicinity thereof in order to measure the temperature of the engine cooling water. A second sensor 17 is arranged to measure the temperature of the hydraulic oil, said second sensor 17 preferably being located in the hydraulic-oil tank 14. A third sensor 18 is located at the compressor 10 in order to measure the compressor-oil temperature. A fourth sensor 19 is located on a suitable place in order to measure the temperature of the charge air and a fifth sensor 20 is located in such a way that the same can measure the temperature of the surrounding air around the drill rig 1. Preferably, the measurement of the ambient temperature is carried out in front of the engine house 5, such as is outlined in the drawings, in order to get as correct and true a measuring as possible. This as a consequence of the warm air that is generated in the engine house 5 being blown out rearward from the same. All sensors 16-20 are in a suitable way operatively connected to the control unit 15 that controls the fans 13 in a suitable way. In the preferred embodiment, the sensors 16-20 are connected to the control unit 15 via electrical cabling (not shown), but also wireless or optic communication between the units is feasible.

In prior art, the fan that creates an air flow through the cooling elements is switched on if the drill rig is in operation. In other words, when the drill rig operates, the fan operates at a constantly high rotation speed (highest power). Characteristic of the drill rig 1 according to the invention is that the rotation speed of the fan 13 can be varied, within a range of from 0% to 100% of the requisite rotation speed, by the control of the same. The fan 13 according to the invention operates all the time when there is a cooling demand, but at a low rotation speed and only exceptionally at the highest rotation speed. The sound that arises during the operation of the fans propagates through the construction and into the driver's cab 4 and creates, at highest rotation speed, noise inside the same, but by means of a regulated fan at a low rotation speed the noise decreases markedly, and furthermore the wear on the same decreases. A decreased power output also entails reduced fuel consumption.

The rotation speed of the fan is controlled or regulated by the control unit 15 based on the determined cooling demands or the temperatures in the cooling elements 12. More precisely, by the fact that the control unit 15 compares or weights together the cooling demands of the cooling elements 12 that constitute a group of cooling elements, after which the individual fan 13 is controlled based on the occurring cooling demand of the cooling elements 12 associated with the respective fan. It is advantageous to control the individual fan 13 that co-operates with the individual group of cooling elements 12 based on the greatest cooling demand among the cooling elements 12 in the group. However, it should be pointed out that also other suitable ways of weighting together the cooling demands are feasible in order to control the fans 13.

In order to determine the cooling demand of the charge-air cooler, also the ambient temperature is measured, since the maximally allowable the charge-air temperature is closely dependent on the ambient temperature, which gives better determination of the cooling demand and further additionally better precision in the control of the fan 13. Furthermore, also the cooling demand of the other cooling elements 12 can be more exactly defined with the knowledge about the ambient temperature.

Said sensors 16-20 need necessarily not consist of sensors specific to the object discussed above with the purpose of providing temperatures only for the fan control, but in certain applications and embodiments of the inventive drill rig 1, values from existing sensors may be used in the determination of the cooling demand of the various cooling elements 12. For instance, the engine water temperature is frequently measured by already existing sensors.

In spite of the fans 13 providing a closer-to-optimal cooling of the cooling elements 12 according to the present invention, some kind of safety thermostats 21 should be comprised that make it impossible for the fluids in the different systems to be cooled below a certain limit value, more precisely by the fact that the fluid in question is not allowed to circulate in the cooling element of the same.

FEASIBLE MODIFICATIONS OF THE INVENTION

The invention is not only limited to the embodiments described above and shown in the drawings. Thus, the method as well as the drill rig may be modified in miscellaneous ways within the scope of the subsequent claims. It should be especially mentioned that the drill rig not necessarily has to comprise a cab but may still be controlled from a position outside the same. It should also be appreciated that each fan may consist of one or more fan elements. It should also be pointed out that even if the cooling elements are divided into groups, the individual fans do not need to have separate control but the fans may be mutually controlled. By way of introduction, it is mentioned that by drill rigs, in particular drill rigs for the drilling in rock above ground are intended, yet the invention is not limited to this but also drilling in other materials and operation below ground are feasible. It should be pointed out that by the expression, regulation of the cooling demand, both in the claims and in the detailed description, it is meant that the cooling demand of the cooling element can be regulated by letting the fan operate, for instance, at different rotation speed. More precisely, by the fact that a high fan speed entails a lower instantaneous cooling demand and a low fan speed entails a higher instantaneous cooling demand. Thus, the cooling demand should neither be too high or too low but is regulated to a suitable level.

The invention claimed is:

1. A method for controlling regulation of cooling demand of a drill rig (1) having an engine house (5) including an engine (9), at least two cooling elements (12), at least one fan (13), a control unit (15) to control i) the fan (13) and ii) the cooling demand in the cooling elements (12), the method comprising the steps of:

determining the cooling demand of each cooling element (12), wherein at least one cooling element (12) is equipped with a safety thermostat (21) located at one end of the cooling element (12);

weighting together the determined cooling demand;

by using the control unit, controlling a rotation speed of the fan (13) based on said weighting together the determined cooling demand; and operating the safety thermostat to prevent overcooling by not allowing fluid to circulate in said at least one cooling element.

2. The method according to claim 1, wherein the at least one fan (13) is controlled based on the cooling demand of the cooling element (12) that has the greatest cooling demand.

3. The method according to claim 2, wherein the rotation speed of the fan (13) is controlled based on the cooling demand of the cooling element (12) that has the greatest cooling demand.

4. The method according to claim 1, wherein the rotation speed of the fan (13) is controlled based on the cooling demand of the cooling element (12) that has the greatest cooling demand.

5. The method according to claim 1, wherein an ambient temperature is measured in order to determine the cooling demand in each one of the cooling elements (12).

6. A method for controlling regulation of cooling demand in a drill rig (1), comprising the steps of:

adapting at least one cooling element (12) to regulate the cooling demand of the drill rig (1) by using at least one fan (13);

determining the cooling demand by measuring an ambient temperature of said at least one cooling element (12) associated with a safety thermostat (21) arranged at one end of the cooling element (12);

comparing the determined cooling demand from each cooling element (12) to control a rotation speed of said at least one fan (13); and operating the safety thermostat (21) to prevent overcooling by not allowing fluid to circulate in said at least one cooling element (12).

7. A method for controlling regulation of cooling demand in a drill rig (1) using at least one fan (13), comprising the steps of:

determining the cooling demand of each cooling element (12); and comparing the cooling demand of each cooling element (12) together to control a rotation speed of each fan (13);

wherein at least one cooling element is equipped with a safety thermostat (21) located at one end of the cooling element (12) to prevent overcooling by not allowing fluid to circulate in the cooling element, wherein said at least one fan (13) is arranged to co-operate with each cooling element (12), and each fan (13) is controlled based on weighting together the cooling demand of each cooling element (12).

8. A control arrangement for cooling demand in a drill rig, comprising:

a control unit (15) arranged to control a rotation speed of at least one fan (13) based on the cooling demand;

a cooling element (12) arranged for fluid to circulate between the cooling element (12), wherein an ambient temperature of the cooling element (12) is measured for the cooling demand, wherein said at least one fan (13), in operation, creates an air flow through the cooling element (12) when the cooling demand is determined in the drill rig; and a safety thermostat (21) arranged to prevent overcooling by not allowing circulation of the fluid in each cooling element (12), wherein at least one of the cooling element (12) is associated with the safety thermostat (21) located at an output of the cooling element (12).

9. The control arrangement according to claim 8, wherein the cooling demand of the cooling element (12) has the greatest cooling demand.

10. The control arrangement according to claim 9, the drill rig comprises at least four cooling elements (12).

11. The control arrangement according to claim 9, wherein the cooling element (12) includes a engine water cooler, a charge-air cooler, a hydraulic-oil cooler and a compressor-oil cooler.

12. The control arrangement according to claim 9, the drill rig is operated by an internal combustion engine which comprises a compressor (10) and a hydraulic-oil pump (11).

13. The control arrangement according to claim 8, the drill rig comprises at least four cooling elements (12).

14. The control arrangement according to claim 8, wherein the cooling element (12) includes a engine water cooler, a charge-air cooler, a hydraulic-oil cooler and a compressor-oil cooler.

15. The control arrangement according to claim 14, wherein said at least one fan (13) is arranged to co-operate with each cooling element (12).

16. The control arrangement according to claim 15, wherein the hydraulic-oil cooler and the compressor-oil cooler constitute a first group cooling element (12), and the engine water cooler and the charge-air cooler constitute a second group cooling element (12).

17. The control arrangement according to claim 15, wherein said at least one fan (13) is associated with one of the first and second group cooling elements (12) based on weighting together of the cooling demand of each group cooling element (12).

18. The control arrangement according to claim 8, wherein the drill rig is operated by an internal combustion engine which comprises a compressor (10) and a hydraulic-oil pump (11).

19. The control arrangement according to claim 8, wherein the drill rig comprises sensors (16-20) in order to measure the ambient temperature corresponding the cooling demand of each one of the cooling elements (12).

* * * * *

UNITED STATES PATENT AND TRADEMARK OFFICE

CERTIFICATE OF CORRECTION

PATENT NO. : 8,567,356 B2
APPLICATION NO. : 12/090381
DATED : October 29, 2013
INVENTOR(S) : Henrik Jacobsson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1907 days.

Signed and Sealed this
Fifteenth Day of September, 2015

Michelle K. Lee

Michelle K. Lee
*Director of the United States Patent and Trademark Office*